United States Patent [19]

Brown

[11] Patent Number: 4,632,428

[45] Date of Patent: Dec. 30, 1986

[54] COMBINATION MEDICAL DATA, IDENTIFICATION AND HEALTH INSURANCE CARD

[76] Inventor: Steven P. Brown, P.O. Box 15786, Philadelphia, Pa. 19103

[21] Appl. No.: 577,267

[22] Filed: Feb. 6, 1984

[51] Int. Cl.[4] ..... B42D 15/00

[52] U.S. Cl. ..... 283/76; 283/112; 283/900

[58] Field of Search ..... 283/7 R, 76, 77, 78, 283/900, 67, 75, 107, 109, 112

[56] References Cited

U.S. PATENT DOCUMENTS

| | | | |
|---|---|---|---|
| 2,588,067 | 3/1952 | Whitehead | 283/904 |
| 2,788,041 | 4/1957 | Carver | 283/904 |
| 3,016,045 | 1/1962 | Robinson | 283/56 X |
| 3,180,042 | 4/1965 | Destal | 40/10 |
| 3,363,346 | 1/1968 | Wittboldt | 283/904 |
| 3,461,581 | 8/1969 | Hoffmann | 283/904 |
| 3,758,970 | 9/1973 | Annenberg | 283/904 |
| 3,792,542 | 2/1974 | Cohan | 283/900 |
| 3,874,979 | 4/1975 | Hannon | 283/904 |
| 3,896,726 | 7/1975 | Staats | 283/904 |
| 3,921,318 | 11/1975 | Calavetta | 283/904 |
| 3,949,501 | 4/1976 | Andrews et al. | 283/904 |
| 4,031,640 | 6/1977 | Hanna, Jr. et al. | 283/900 |
| 4,066,873 | 1/1978 | Schatz | 283/904 |
| 4,141,400 | 2/1979 | Mangan | 206/39.6 |
| 4,202,120 | 5/1980 | Engel | 283/904 |
| 4,236,332 | 12/1980 | Domo | 283/900 |
| 4,245,035 | 1/1981 | Poshkus | 283/904 |
| 4,259,391 | 3/1981 | Brecht | 283/76 X |
| 4,276,704 | 7/1981 | Heller | 40/2.2 X |
| 4,318,554 | 3/1982 | Anderson et al. | 283/900 |
| 4,330,350 | 5/1982 | Andrews | 283/904 |
| 4,338,025 | 7/1982 | Engel | 283/904 |
| 4,435,912 | 3/1984 | Adrian et al. | 283/76 X |

OTHER PUBLICATIONS

Brochure & Letter, "Medical Data Card", U.S. Medicom Corp., Pub. 1-83.

*Primary Examiner*—Paul A. Bell
*Attorney, Agent, or Firm*—Robert C. Podwil

[57] ABSTRACT

An eye and machine readable medical data, identification and health insurance card provides two "leaves", each of which has two faces upon which data may appear. The leaves, which are card-like members, are interconnected by a self-hinge, and may be folded with respect to each other or made to lie flat. The data includes eye-readable material on the card as well as on a microfilm strip associated with the card, and also machine-readable indicia such as the bearer's medical history, including, if so desired, an electro-cardiogram.

14 Claims, 14 Drawing Figures

FIG. 3
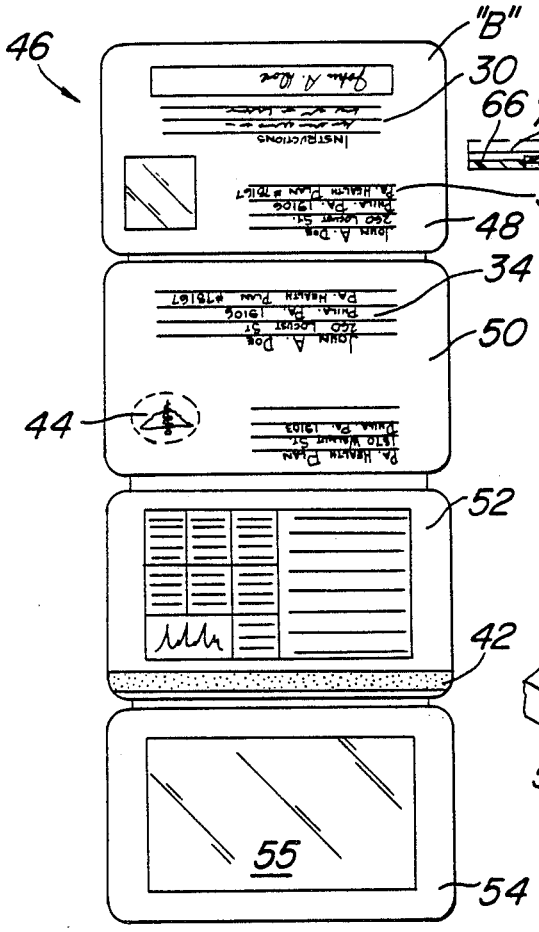
FIG. 5
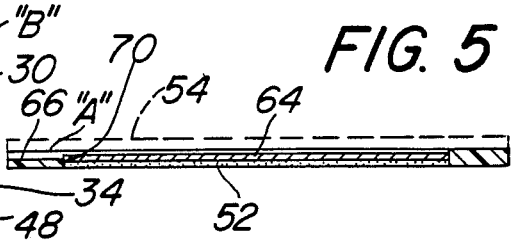
FIG. 6
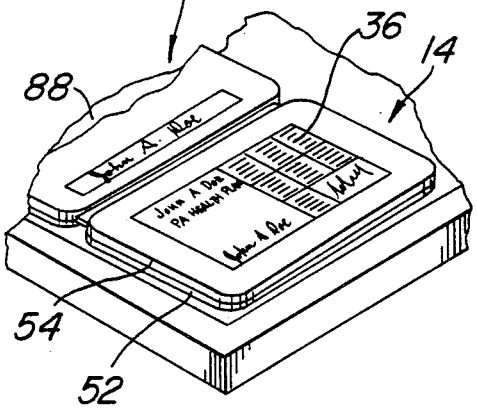
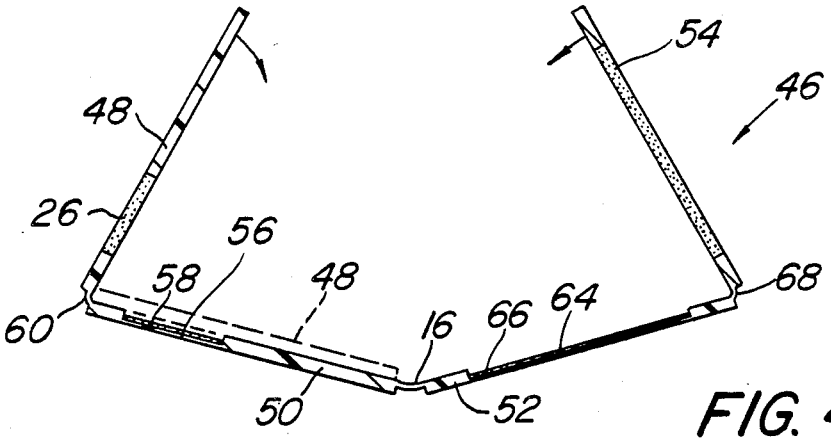
FIG. 4

FIG. 7
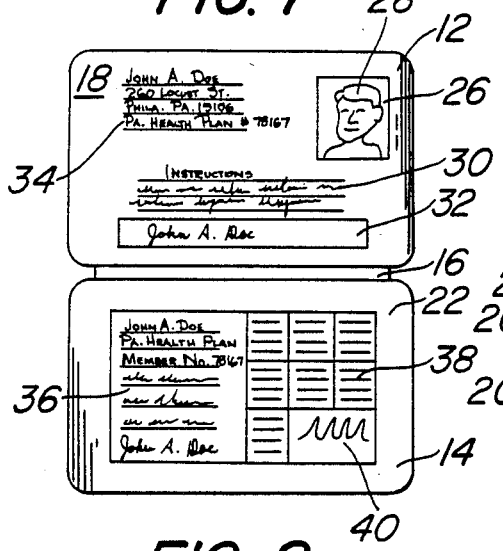
FIG. 8
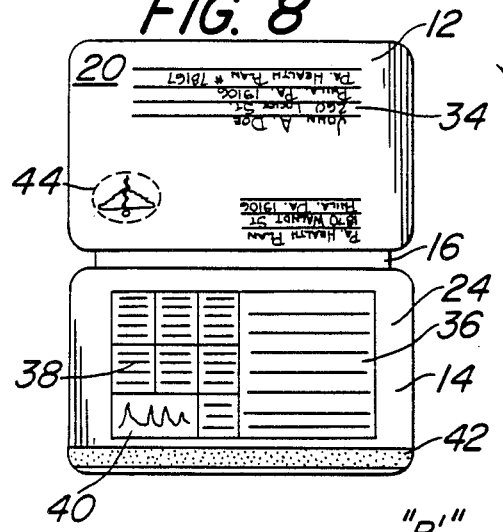
FIG. 9
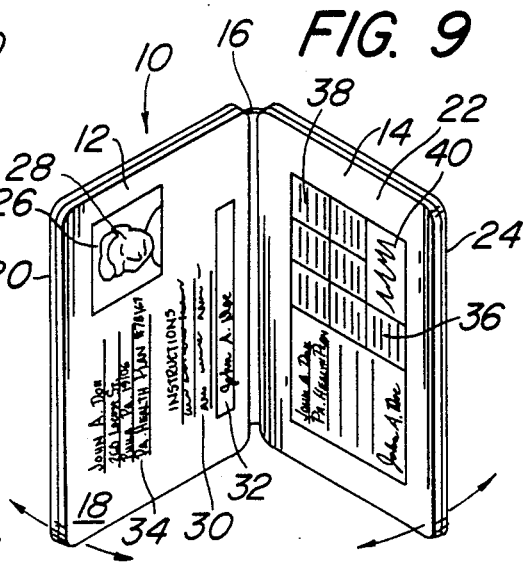
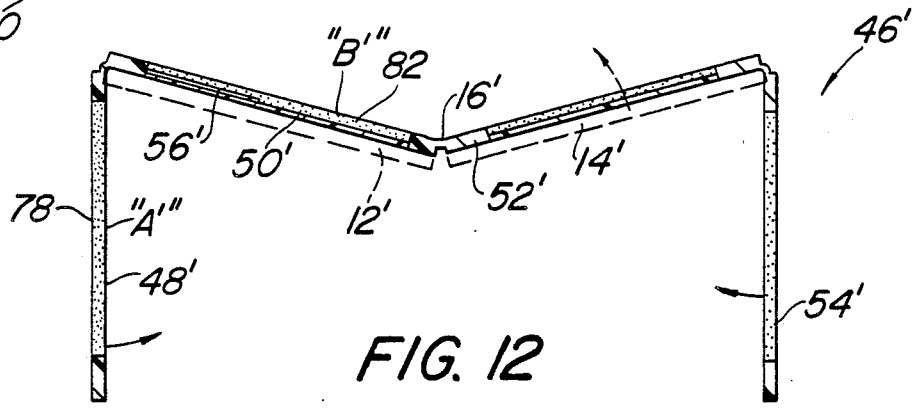
FIG. 12

FIG. 10
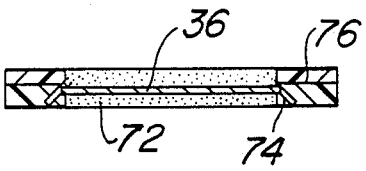
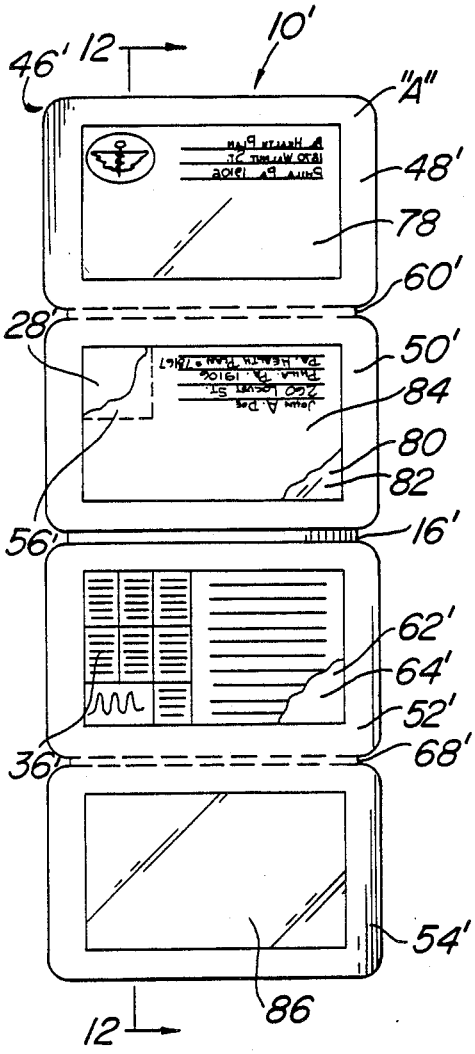
FIG. 11
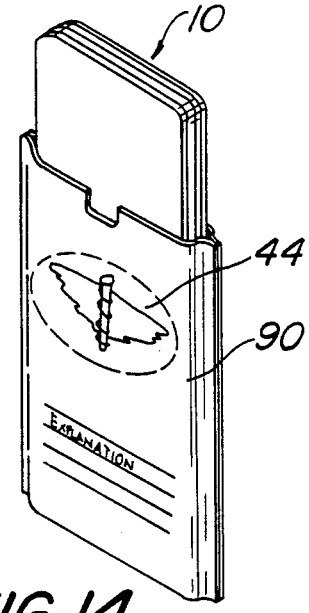
FIG. 14
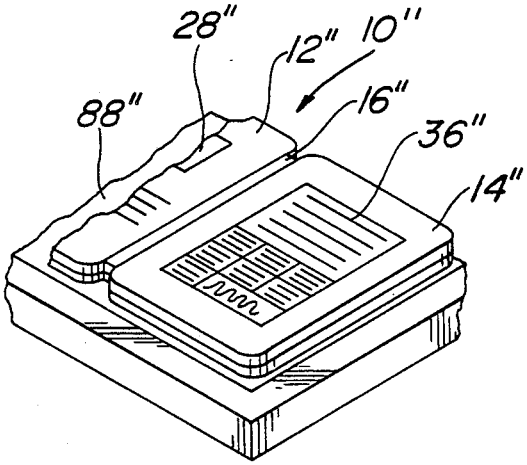
FIG. 13

COMBINATION MEDICAL DATA, IDENTIFICATION AND HEALTH INSURANCE CARD

BACKGROUND OF THE INVENTION

This invention relates to a combination medical data, identification and health insurance card, and more particularly, to a card capable of being carried in a wallet or pocket, and which can contain a substantially complete medical history and other data concerning the bearer.

A crucial aspect in the delivery of quality medical care is the timely availability to attending medical personnel of detailed information concerning the patient's condition and medical history. Such information is particularly important in emergency situations, in which communication with the patient may be impaired or impossible. It is therefore the principal object of this invention to provide a data card which can supply to medical personnel an extensive and perhaps complete microfilmed medical history, eye-readable emergency-oriented personal and medical data, and the possibility of access to a central medical records bank. Another object of this invention is to provide a data card which is easy to construct and extremely durable, and which provides an effective arrangement and display of a large amount of pertinent information. An additional aspect of the invention is the ability of the card to retain the microfilmed information in a fixed orientation in which it can readily be read or reproduced by means of conventional microfiche readers or reader/printers.

Numerous medical data cards have heretofore been proposed. Among these are those shown in U.S. Pat. No. 3,921,318, to A. Calavetta, issued Nov. 25, 1975; U.S. Pat. No. 4,031,640, to C. B. Hanna, Jr. et al., issued June 28, 1977; U.S. Pat. No. 4,236,332, to Domo, issued Dec. 2, 1980; and U.S. Pat. No. 4,318,554, to Anderson et al., issued Mar. 9, 1982.

Even the most informative of such prior art cards provides relatively sketchy information, because it attempts to provide in the area of only two card faces information concerning (1) the issuing institution or organization and (2) eye-readable identification of the card holder, in addition to (3) whatever microfilm information can be disposed in the area available. The present card provides, on four card faces, all of the above information, including a complete medical history and, in useable form, a microfilmed electrocardiogram. It also provides an appreciable amount of emergency-oriented eye-readable data-current ailments, blood type, allergies, prescribed medications, etc.—which should be noted in such situations, as well as a facial photograph of the card holder. All the machine readable microfilmed data is so positioned on the card as to be readily readable and reproduceable by means of conventional microfiche reading/printing apparatus. In essence, therefore, such a card would enable attending personnel to immediately review eye-readable emergency data and, in conjunction with a reader/printer, additionally avail themselves of a hard copy, multipage, medical profile/history (including an electrocardiogram) within a matter of two to three minutes.

The present card could also, if so desired, afford authorized access to and retrieval from a central medical records bank (such as at a hospital or health maintenance organization), which stores additional computerized records. Other uses will occur to those skilled in the art.

BRIEF DESCRIPTION

In general, the above and other objects of the present invention are achieved by a medical data and identification card which provides a pair of card-like members, each having two useable card faces, interconnected by a hinge. The card-like members are formed integrally from a single piece of plastic polymeric material, by molding or die stamping. Although a wide variety of variations is possible within the scope of the present invention, one card face may provide a photograph of the card holder, along with data which identifies the card holder and the issuing organization, and describes the nature of the card. Another card face may have on it general information regarding the issuing organization and identifying data regarding the card holder, while another may have, as mentioned above, a microfilmed medical history, including an electrocardiogram. The machine-readable medical history may be combined with eyereadable medical and personal data, which additionally affords a method of matching and self-verification of the microfilm with the adjacent card face.

In the invention the card-like elements approximate or are the size of a standard credit card, and are so interconnected that the card can be readily positioned within the carriage bed of a conventional microfiche reader/ printer, thus facilitating reading and the production of hard copies of the medical history from the data on the card.

For the purpose of illustrating the invention, there are shown on the drawings forms of the invention, which are presently preferred. It should be understood, however, that the invention is not limited to the precise arrangements and instrumentalities shown.

DESCRIPTION OF DRAWINGS

FIG. 3 is an elevation view of the reverse side of the card shown in FIG. 2, with microfilm strip in place.

FIG. 4 is a cross-sectional view of a card in accordance with the invention, at an intermediate stage of manufacture.

FIG. 5 is a cross-sectional view taken along the line 5—5 in FIG. 2.

FIG. 6 is a perspective view, showing the manner in which an embodiment of a card in accordance with the invention can cooperate with the carriage bed of a microfiche reader.

FIG. 7 is an elevation view of a card in accordance with the invention.

FIG. 8 is an elevation view of the reverse side of the card depicted in FIG. 7.

FIG. 9 is a perspective view of a card in accordance with the invention, in the process of being folded for carrying in a wallet or the like, or, alternatively, being unfolded for viewing of medical data.

FIG. 10 is a partial cross-sectional view showing details of an alternative form of card in accordance with the invention.

FIG. 11 is an elevation view, showing a detail of an alternative form of card in accordance with the invention.

FIG. 12 is a cross-sectional view of an alternative form of card in accordance with the invention, at an intermediate stage of manufacture.

FIG. 13 is a perspective view, showing the manner in which an alternative emobidment of a card in accordance with the invention can cooperate with the carriage bed of a microfiche reader.

FIG. 14 is a perspective view, showing the manner in which the invention may be folded and stored for carrying.

DETAILED DESCRIPTION

Figure 1:
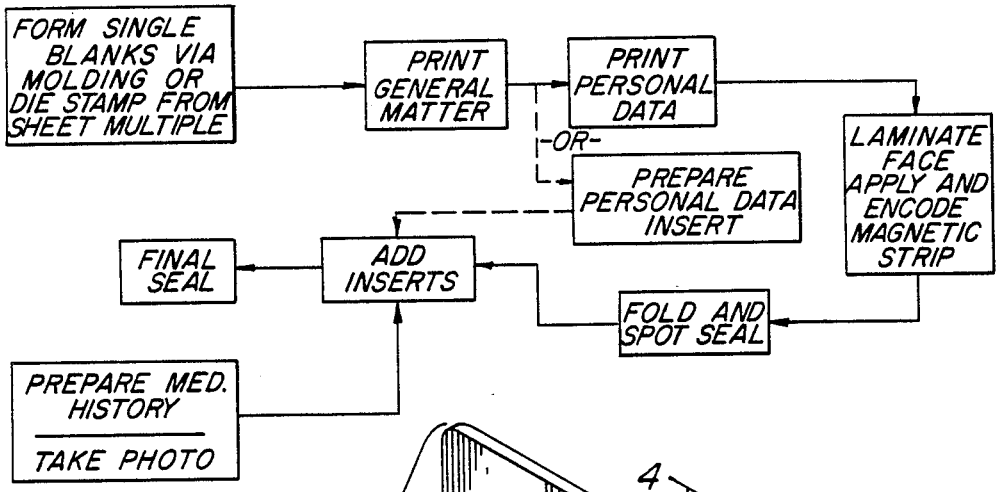
FIG. 1 is a flow chart, describing a sequence of steps which may be taken in the production of a data and identification card in accordance with the invention.

Referring now to the drawings in detail, wherein like reference numerals indicate like elements, there is seen in FIG. 9 an eye-and machine-readable medical data and identification card (sometimes hereafter referred to as a "data card"), designated generally by the reference numeral 10. The data card 10 comprises a first generally rectangular card-like member 12 and a second generally rectangular card-like member 14. The card-like members 12 and 14 are formed from plastic polymeric material, and interconnected by an integral hinge 16 of the so-called "self" or "living" type. In other words, the hinge 16 is molded from the same material which forms the card-like members 12 and 14 and is integral with those members.

The hinge 16 permits rotation of the card-like members 12 and 14 from positions in which they are substantially coplanar (as shown in FIGS. 7 and 8) to one in which they lie adjacent each other in face-to-face relation. FIG. 9 illustrates the card-like members 12 and 14 in an intermediate position.

Each of the card-like members, it will be appreciated, provides a pair of oppositely disposed card faces, as is perhaps best seen in FIGS. 7 and 8. Referring, for example to FIG. 7 and also the above-mentioned FIG. 8, the card-like member 12 provides a card face 18. Referring to FIG. 8, the card-like member 12 also provides a card face 20, opposite to the card face 18. Similarly with reference to FIGS. 8 and 9, the card-like member 14 provides a card face 22 and an oppositely disposed card face 24, which is seen in FIG. 8.

The data card 10 carries in a unique manner a variety of eye and machine readable indicia. For example, referring again to FIGS. 7 through 9, the data card 10 has on its face 18 a transparent area 26 through which a photograph 28 of the bearer may be seen. It also carries a set of printed instructions 30 concerning the nature and use of the card, as well as a signature strip 32. The card faces 18 and 20, in the illustrated form of the invention, each also carry a segment 34 of indicia which sets forth the bearer's name, address, medical plan affiliation and membership number.

The card faces 22 and 24 provide transparent areas through which there may be seen a microfilm strip 36, described in greater detail below, which carries both eye-readable and machine readable portions of the bearer's medical history. The strip 36 may contain the card holder's signature for verification against the signature 32 and, again, the health maintenance organization or medical insurance plan affiliation and membership number, also for verification against that on card face 18, as shown in FIG. 7. These aspects of the material contained on the strip 36 may be eye-readable, as is the emergency-oriented medical data. Also contained on the strip 36 can be a complete medical history 38, contained on several pages of material reduced to microfiche. The medical history 38 preferably includes an electrocardiogram 40. Each microfilm frame will preferably be a 16 mm frame of film with a reduction ratio of 1:24. This ratio facilitates the rapid location, reading and subsequent printing of any or all frames of the medical history in conjunction with the standard 24× indexed locating grid of a microfiche reader-printer. Microfiche of other reduction ratios customarily utilized in medical records—notably 1:32 and 1:48—may likewise be accommodated within the present invention, and may readily function in cooperation with the reader-printer upon substituting the appropriately indexed locating grid.

As is seen in FIG. 8, the card face 24 may also include an encoded electromagnetic strip 42. The strip 42, it is contemplated, will permit authorized access to and retrieval of supplemental microfilmed and/or computer-stored medical information. Referring again to FIG. 8, a logotype 44 or other identifying indicia of the bearer's health maintenance organization or medical insurance plan may also be applied to the card face 20, to enable personnel at medical facilities or other related parties (pharmacists, paramedics, etc.) to readily identify the issuer of the card.

Because the data card in accordance with the present invention provides two card-like members and four card faces, it is capable of carrying far more medical information than prior identification cards, without sacrificing the ability to contain all desirable eye-readable personal and medical indicia regarding the card holder, as well as indicia regarding the organization of which he is a member. Unlike earlier cards, virtually the entire cardlike member 14 can be devoted to medical history; and it is thus feasible to supply not only a complete medical history in narrative form, but the electrocardiogram 40 as well. With respect to the strip 36, it includes, in its illustrated form, the equivalent of seven pages of letter-size typed or printed material. The electrocardiogram 40 encompasses an area which is the equivalent of two pages thus reduced, although it has been found that a useful electrocardiogram can encompass an area as small as the microfiche equivalent of a single letter-size page.

Figure 2:
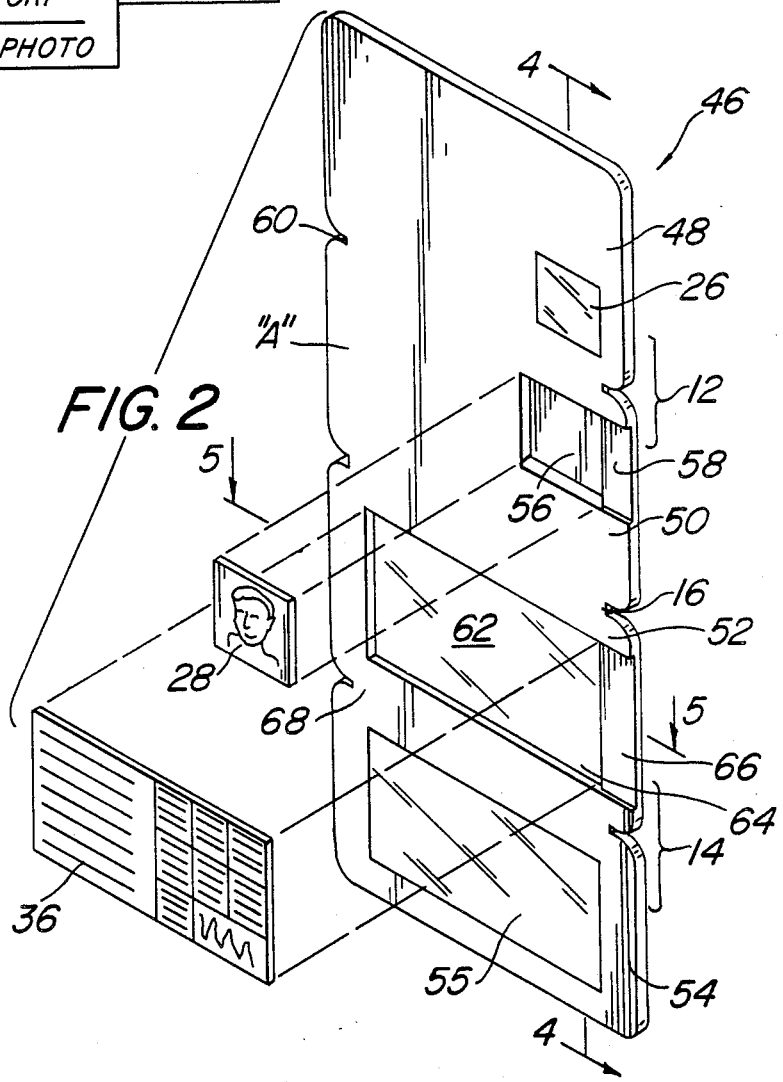
FIG. 2 is a perspective view of a form of a card in accordance with the invention, in unassembled condition.

Referring now to FIGS. 2 and 4, the manner in which a presently preferred form of an identification card 10 may be made will be described in detail. Seen in FIG. 2, in perspective, is an individual blank from which an identification card 10 may be made. The blank 46 may be made by a number of suitable processes which will occur to those skilled in the art. For example, blanks may be die stamped from sheet multiples (not illustrated) or molded to form the individual blanks 46. Polypropylene is one suitable material.

The blank 46, in a manner which will now be explained, may subsequently be folded to form the abovedescribed card-like members 12 and 14, interconnected by the hinge 16.

Referring now to FIG. 2, each of the card-like members 12 and 14 is itself formed from respective pairs of card elements 48 and 50 and 52 and 54. The card element 48 contains the transparent "window" 26, mentioned above, while the card element 50 contains a somewhat larger recessed bed 56 adapted to receive a photograph of the bearer. A relieved portion, or slot 58, may extend from an outer edge of the card element 50 into communication with the recessed bed 56, for a purpose described below. A self-hinge 60 interconnects the card elements 48 and 50.

The card element 52 provides a transparent "window" portion 62, the purpose of which is explained below, and a recessed bed 64, which is adapted to receive the above-mentioned microfilm strip 36. A relieved portion, or slot 66, may extend from an outer edge of the card element 52 into communication with the recess 64. The card elements 52 and 54 (which also has a window portion 55), like the above-described card elements 48 and 50, are joined by a self-hinge, designated by the reference numeral 68.

FIGS. 3 and 4 illustrate some of the steps by which the blank 46 may be processed to produce a preferred configuration of the data card 10. In this regard, referring to FIG. 3, general matter common to all cards, such as the name and address of the issuing organization, logotype 44 as well as instructions 30, may be printed upon the blank 46. Following this, personal indicia 34 regarding the card holder (name, address, medical plan affiliation and membership number) is applied. Next, the blank 46 may be folded as depicted in FIG. 4, so that the card element 48 is made to overlie the card element 50 and the card element 54 to overlie the card element 52. Referring to FIGS. 2 through 4, it will be seen that in the illustrated embodiment both self-hinges 60 and 68 are formed flush with the face "A" of the blank 46 seen in FIG. 2, but recessed from the face "B" seen in FIG. 3, so as to facilitate folding in this manner. The card elements 48 and 50 and 52 and 54 may be temporarily "tacked" to each other (by heat sealing or adhesive means) at this time. Folding of the blank 46 in the above manner yields the configuration seen in FIGS. 7 through 9 and described above. The photograph 28 and microfilm strip 36 may now be inserted into the respective recessed beds 56 and 64 by sliding them through the respective relieved portions or the slots 58 and 66.

One configuration of the recessed bed 64 and relieved portion or slot 66 associated with it is seen in FIG. 5. That configuration may also be used for the recessed bed 56 and relieved portion or slot 58. As will be seen, the depth of the recessed bed 64 from the face "A" of the blank 46 can be made so as to exceed that of the relieved portion or slot 66. If it is so made, the intersection of the recessed bed 64 and relieved portion or slot 66 provides a lip 70 which, in association with the face of the card element 54 overlying the recessed bed 64, serves to retain the microfilm strip 36 within the recessed bed 64. A similar configuration can retain the photograph 28 in the recess 56 in a like manner. After insertion of the photograph 28 and microfilm strip 36 into the respective recessed beds 56 and 64, the card elements 48 and 50 and 52 and 54 may be sealed together to complete the data card 10. It is also feasible to have the depths of the slots 58 and 66 equal to the depths of the recessed beds 56 and 64, respectively, so that the slots 58 and 66 are, in effect, extensions of the beds 56 and 64.

The use of the above-described relieved portions or slots 58 and 66 to enable insertion of the photograph and microfilm strip after construction of the identification card 10 is presently preferred, although use of the relieved portions or slots 58 and 66, while advantageous, may be considered optional. If, for example, it were desired to fabricate the identification card 10 in a commercial setting in which completion of the card 10 is done in conjunction with concurrent production of the microfilm record and the photograph, the relieved portions or slots could well be omitted, and the photograph and microfilm strip simply placed in their respective recessed beds 56 and 64 before bonding of the data card 10.

FIG. 10 illustrates, in cross-section, an alternative arrangement which may be used when the relieved portions or slots are omitted. Referring to FIG. 10, a recessed bed 72, like the above-described beds 56 and 64, may be configured so as to prevent shifting of the strip 36 and photograph 28 during the fabrication and the sealing process. This is accomplished by providing, at the line of intersection of the walls of the recessed bed 72 with the flat bottom of the bed, "slits" 74 which extend lengthwise along the bed. The slits 74 are oriented at approximately a 135 degree angle with respect to the bottom of the bed. The edges of the strip 36 (or photograph 28) can engage the slits 74 to be retained in the recessed bed 72 during completion of the card. Alternatively, or in addition to the slits 74, a protruding lip 76 may be provided, into which edges of the strip 36 (or photograph 28) can snap Within the concept of the present invention, numerous other variations are practical. Thus FIGS. 11 and 12 illustrate an alternative embodiment of the invention, wherein elements corresponding to those previously described are designated by like primed (') reference numerals.

In FIG. 11, the blank 46' includes card elements 48' and 50', interconnected by a self-hinge 60'. Card elements 52' and 54' are interconnected by a self-hinge 68', and a self-hinge 16' interconnects the card elements 50' and 52'. The self-hinges 60' and 68' are formed flush with the face "A' " of the blank 46'; and recessed from the face "B'". However, the self-hinge 16' is formed flush with the face "B'" , and recessed from the face "A'".

The data card 10' shown in FIGS. 11 and 12 also differs from the data card 10 in the following other respects. The photograph 28' rests within a recessed bed 56' in the card element 50', facing side "B" of Card 10'. A portion of transparent window 82 in this same card element 50' serves as the base for the recessed bed 56'. Consequently, window 82 renders a photograph 28', received in the recessed bed 56', visible from face "B" of card element 50' of the completed identification card 10'. The card element 52' contains a recessed bed 64', adapted to receive a microfilm strip 36', and a window portion 62'. The card element 54' likewise has a transparent window portion 86. The card element 50', however, is also provided with a recessed bed 80, adapted to receive an insert 84. The insert 84 may be a thin plastic sheet upon which is printed, in duplicate, the cardholder's name, address, medical plan affiliation and membership number (indicia 34). Or, alternatively, insert 84 may incorporate the photo 28', thereby combining either photographically or by mechanical means the cardholder's photo and indicia 34 on a single insert. The insert 84 may be printed on one side and folded before insertion, or printed on two sides and inserted unfolded. Thus, information pertaining to the nature of the card, the issuing organization and the like could be preprinted on the card 10', perhaps on the card elements 48' (as shown) and 50'. The personalized indicia 34 contained on the insert 84 could be viewed, subsequently, through a transparent window 82 on side "B" of card element 50' and the similar window portion 78 on side "B" of card element 48'.

In essence, therefore, side "B" of card elements 50' and 48' in the assembled card 10' would afford card faces similar in appearance, respectively, to card faces 18 and 20 in FIGS. 7 and 8.

FIG. 12 illustrates the manner in which the blank 46' for the data card 10' may be folded to complete the card 10'. Thus, referring to FIG. 12, the card element 48' may be folded in the direction indicated by the solid arrow to abut the card element 50' on its face "A'". Similarly, the card element 54' may be folded in the direction of the solid arrow to abut the card element 52'. The resulting card-like members 12' and 14' may be rotated with respect to each other about the hinge 16' to a folded condition.

Referring now to FIG. 6, it is illustrated how data cards such as 10 and 10' lend themselves to use with conventional microfiche viewing apparatus. In FIG. 6, the card 10 is seen, positioned for viewing in the carriage bed 88 of a microfiche viewer. Because the film strip 36 resides in a recessed bed 64, it is spaced from the lens of the microfiche viewer by only a part of the thickness of the card-like member 14. Thus, the film strip 36 lies within the focal range of the viewer.

FIG. 13 illustrates another embodiment of the invention, in which an identification card in accordance with the invention is particularly well-adapted to cooperate with a microfiche reader. Referring to FIG. 13, wherein elements corresponding to those previously described are designated by like double-primed (") reference numerals, a data card 10" comprises respective card-like members 12" and 14", interconnected by a self-hinge 16". The identifying printed matter relating to the card holder and the issuing organization, photograph 28" and microfilm strip 36" are so oriented with respect to the members 12" and 14" of the card 10" that, likewise, they may be viewed when the card 10" is opened in "book" fashion. In such an arrangement, the card-like members 12" and 14" can be made the size of a "standard" credit card (approximately 54 mm by 87 mm). Such a card 10" in a machine-readable position, as shown in FIG. 13, would therefore measure approximately 108 mm in width (2×54 mm) by 87 mm in height (the "long" dimension of each card-like member 12", 14"). Conventional microfiche reading apparatus utilize a standard carriage bed measuring 148 mm wide by 105 mm deep, so the card 10" fits easily within the carriage bed. Conversely, accommodation of cards such as 10 and 10' within such a carriage bed necessitates their being slightly smaller in size than the "standard" credit card.

FIG. 14 illustrates the manner in which a data card 10; 10' or 10" in accordance with the invention may readily be carried. A vinyl case or sleeve 90, the outside measurements of which are sufficient to receive the data card 10, may be provided, so that when the data card 10 is folded it may readily be placed in the sleeve 90 and carried in a wallet or pocket. The case or sleeve 90 may have upon it the logotype 44 and other identifying and descriptive indicia, such as a recognizable medical symbol and information in several languages regarding the nature of the card within.

FIG. 1 illustrates, by means of a flow chart, the steps by which cards 10, 10' or 10" in accordance with the invention may be made. As has been indicated, sheets of multiple blanks may be produced (if die stamping techniques are subsequently used), or individual blanks produced using molding techniques. Sheets or individual blanks having been formed, general printed matter regarding the issuing organization (name, address and logotype 44) and instructions 30 is applied. The blanks are subsequently personalized by applying indicia 34—the member's name, address, medical plan affiliation and membership number. Alternately, as in the case of card 10', an insert 84 containing the same personal indicia 34 may be made. The medical microfilm strip 36 and photograph 28 may also be prepared at this stage, for inclusion within either card 10, 10' or 10".

Side "B" of the blanks is now laminated, and individual blanks die cut from those in multiple, sheet form. The electromagnetic strip is subsequently applied and encoded, and the signature strip applied.

The printing procedures, it should be noted may simultaneously entail all pertinent card faces of the blanks, whether these be multiple blanks in sheet form or individual blanks. Alternative printing procedures, moreover, are feasible. Such alternative procedures may be desirable when using sheets of multiple blanks, since blanks originating in sheet form lend themselves to various modes of printing, die cutting and combinations thereof.

Next, the blanks, similar at this point to the four-part configuration of the blank 46, are folded and temporarily "tacked" in assembled fashion, and inserts added. Finally, the edges of the card 10 may be sealed around the periphery of the respective card-like members, to complete the assembly.

The microfilm strip 36 may be contained on a silver-gelatin emulsion film, although diazo techniques may also be used. One suitable polyester-based silver-gelatin film which may be used to advantage in the present invention is the so-called "Image Capture" product of Eastman Kodak. The design and contruction of the present data card 10 afford the microfilm strip 36 inherent protection from humidity, heat and sunlight.

The present invention may be embodied in other specific forms without departing from its spirit or essential attributes, and, accordingly, reference should be made to the appended claims rather than the foregoing specification as indicating the scope of the invention.

I claim:

1. An eye and machine readable medical data, identification and health insurance card, comprising a first generally rectangular card-like member providing thereon a pair of oppositely disposed card faces, a second generally rectangular card-like member providing thereon another pair of oppositely disposed card faces, said card-like members being formed from an integral piece of plastic polymeric material; plastic polymeric self-hinge means interconnecting said card-like members to that said card-like members can selectively be disposed in coplanar relationship or superimposed upon each other; said card-like members comprising pairs of card elements superimposed in face-to-face relation when the card is operatively disposed, said card elements of respective card-like members being hingedly interconnected by self-hinge means disposed at respective edges of said card element; and at least one of the card elements of one of said card-like members having means thereon for retaining an insert within and operatively in association with said one of said card-like members.

2. An article in accordance with claim 1, wherein said means for retaining an insert comprises a recessed portion for receiving an insert.

3. An eye and machine readable medical data, identification and health insurance card, comprising a first generally rectangular card-like member providing thereon a pair of oppositely disposed card faces, a second generally rectangular card-like member providing thereon another pair of oppositely disposed card faces, said card-like members being formed from an integral piece of plastic polymeric material; plastic polymeric self-hinge means interconnecting said card-like members so that said card-like members can selectively be disposed in coplanar relationship or superimposed upon each other; said card-like members comprising pairs of card elements superimposed in face-to-face relation when the card is operatively disposed, said card elements of respective card-like members being hingedly interconnected by self-hinge means disposed at responsed at respective edges of said card element; at least one of the card elements of one of said card-like members having a transparent face thereon and the other of the card elements of said card-like member having a recessed portion for receiving an insert therein.

4. An eye and machine readable medical data, identification and health insurance card, comprising a first generally rectangular card-like member providing thereon a pair of oppositely disposed card faces, a second generally rectangular card-like member providing thereon another pair of oppositely disposed card faces, said card-like members being formed from an integral piece of plastic polymeric material; plastic polymeric self-hinge means interconnecting said card-like members so that said card-like members can selectively be disposed in coplanar relationship or superimposed upon each other; said card-like members comprising pairs of card elements superimposed in face-to-face relation when the card is operatively disposed, and card elements of respective card-like members being hingedly interconnected by self-hinge means disposed at respective edges of said card element; and said card-like members having thereon eye-readable visible indicia in relation to the bearer and medical record microfilm indicia in relation to the bearer.

5. An article in accordance with claim 4, wherein said card-like members have thereon eye-readable visible indicia and medical record microfilm indicia in relation to the bearer, said medical record microfilm indicia comprising an electrocardiogram and a medical history in relation to the bearer.

6. An article in accordance with claim 5, wherein said eye readable indicia includes a photograph of the bearer.

7. An article in accordance with claim 5, wherein said medical history comprises microfilm images of a multiplicity of written or printed pages comprising said medical history.

8. An article in accordance with claim 7, wherein said eye-readable indicia includes a photograph of the bearer.

9. An article in accordance with claim 4, wherein at least one of said card elements which comprise one of said card-like members has a transparent face thereon, at least one of said elements having a recessed portion therein adapted to receive at least one insert having indicia thereon.

10. An article in accordance with claim 9, wherein said last-mentioned element includes a slot in communication between one edge thereof and said recessed portion, whereby at least one said insert may be inserted into said recessed portion.

11. An article in accordance with claim 4, wherein said indicia are oriented on said card-like members in lines extending in the direction of the larger dimension of said card-like members, said lines being oriented in a direction generally parallel to said self-hinge means.

12. An article in accordance with claim 4, wherein said indicia are oriented on said card-like members in lines extending in the direction of the smaller dimensions of said card-like members, said lines being oriented in a direction generally perpendicular to said self-hinge means.

13. An article in accordance with claim 12, wherein the length of the card-like members in the direction of their larger dimension approximates the size of a conventional credit card.

14. An article in accordance with claim 4, wherein each of said card-like members carries indicia of the bearer's name, medical plan affiliation, membership number and signature, the indicia on respective card-like members being so positioned on said card-like members as to be similarly oriented and readily verifiable one against the other when said card-like members are disposed in coplanar relationship.

* * * * *